US007870714B2

(12) United States Patent
Sikula et al.

(10) Patent No.: US 7,870,714 B2
(45) Date of Patent: Jan. 18, 2011

(54) AIR-SPLICING DEVICE FOR SPLICE-CONNECTING TWO GLASS FIBER ROVING STRANDS AND PROCESS OF SPLICE-CONNECTING SAME

(75) Inventors: Dusan Sikula, Trnava (SK); Marek Hajtman, Trnava (SK); Frantisek Sabo, Trnava (SK)

(73) Assignee: Johns Manville, Denver, CO (US)

( * ) Notice: Subject to any disclaimer, the term of this patent is extended or adjusted under 35 U.S.C. 154(b) by 155 days.

(21) Appl. No.: 12/328,470

(22) Filed: Dec. 4, 2008

(65) Prior Publication Data

US 2009/0139197 A1 Jun. 4, 2009

(30) Foreign Application Priority Data

Dec. 4, 2007 (EP) ..... 07023410

(51) Int. Cl.
*B65H 69/06* (2006.01)

(52) U.S. Cl. ..... 57/22

(58) Field of Classification Search ..... 57/22, 57/202

See application file for complete search history.

(56) References Cited

U.S. PATENT DOCUMENTS

2004/0118099 A1* 6/2004 Zewde et al. ..... 57/244
2004/0168425 A1* 9/2004 Kawamura et al. ..... 57/22

* cited by examiner

*Primary Examiner*—Shaun R Hurley
(74) *Attorney, Agent, or Firm*—Robert D. Touslee

(57) ABSTRACT

An Air-splicing device for splice-connecting two glass-fiber roving strands (1, 3), comprises a strand channel (6) open at its two opposing ends (7, 8), two splice chambers (9, 10) arranged side-by-side in said strand channel, at least three strand clamps (13, 14, 15, 16) two of which are outer strand clamps (13, 15) arranged at either side outside of said two splice chambers and at least one of which is an inner strand clamp (14, 16) arranged between said two splice chambers, and two strand cutters (17, 18) arranged at the opposite ends of the strand channel. Said first and second splice chambers are feedable with pressurised air independently of each other.

14 Claims, 2 Drawing Sheets

AIR-SPLICING DEVICE FOR SPLICE-CONNECTING TWO GLASS FIBER ROVING STRANDS AND PROCESS OF SPLICE-CONNECTING SAME

TECHNICAL FIELD

The present invention relates to an air-splicing device for splice-connecting two glass fiber roving strands. In particular, the present invention may relate to a hand-held air-splicing device for said application.

BACKGROUND

There are available on the market various air-splicing devices for knot-free joining of filament yarns such as the AirSplicer™-17-2 and the AirSplicer™-40-2, both of Heberlein Fiber Technology, Inc., 9630 Wattwil (CH). Whereas glass fiber rovings are mentioned as a possible application of the AirSplicer™-40-2, the results that may be achieved so far are not satisfactory. In fact, tests have revealed that the splice joint of two glass roving strands may be of poor quality in the terms of strength; in a typical application the strength of the splice joint was tested to be only about 35% of the strength of the regular roving strands.

In addition to the prior art discussed above, there are various patent publications relating to air-splicing devices for splice-connecting threaded filament yarns. Typically, the respective devices comprise one splice chamber similar as it applies to the above mentioned prior art devices. However, there are also disclosed air-splicing devices having two splice chambers arranged in series (e.g. U.S. Pat. No. 4,292,796, GB 956992, and DE 4226025). But again, in spite of glass fiber filament yarns being mentioned in German Letters patent 4226025, these devices do not perform well in glass fiber rovings related applications.

SUMMARY

In view of the prior art discussed above, the present invention aims at providing for an air-splicing device, such as a hand-held air-splicing device, particularly suited for splice-connecting two glass fiber roving strands. Similarly, the present invention aims at providing for a process of splice-connecting two glass fiber roving strands by making use of such an air-splicing device, which process results in an improved quality of splice joints in splice-connecting of glass fiber roving strands.

In accordance with the present invention the object set out above is achieved by an air-splicing device for splice-connecting two glass fiber roving strands. Similarly, the above-identified object is achieved by a process of splice-connecting two glass fiber roving strands.

DETAILED DESCRIPTION

Figure 1:
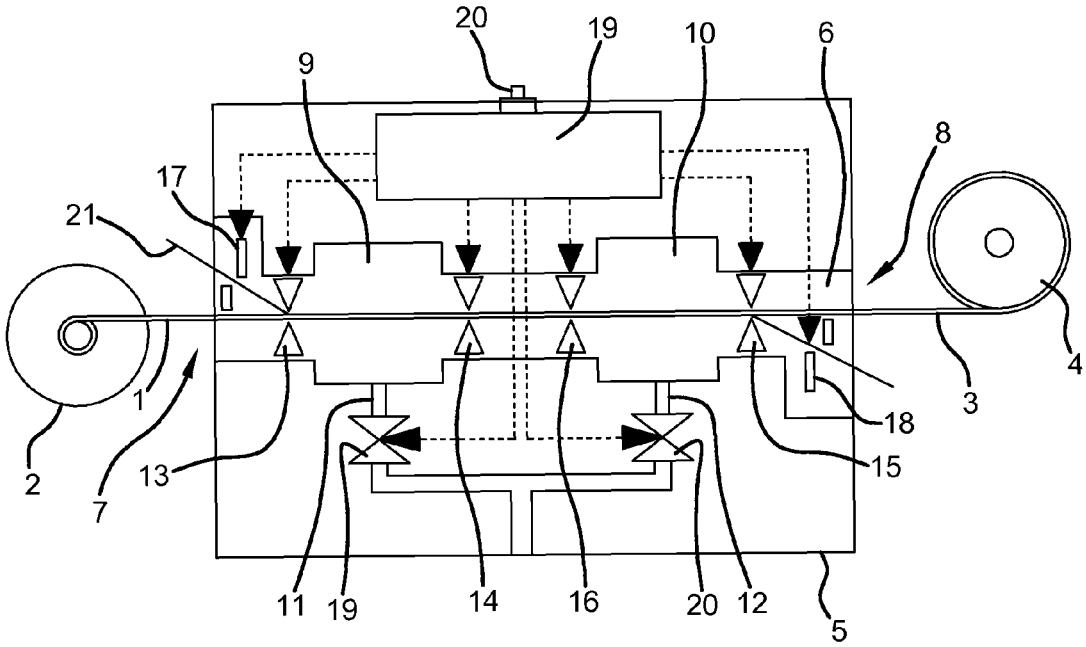
FIG. 1 is a cross-section of the air-splicing device according to the principles of the present disclosure.

Accordingly two of the key features of the present invention which act together with the remaining features of the respective claimed combination are that, in the strand channel, two splice chambers are provided side by side with at least one strand clamp in-between which splice chambers are capable of being fed by pressurized air independently of each other. In contrast to what is taught in the above-mentioned references relating to air-splicing devices with two splice chambers, the two splice chambers of the air-splicing device of the instant invention are not fed simultaneously with pressurized air. Rather the two splice chambers are fed with pressurized air in a timely offset manner. This might even include that the second splice chamber is not launched before feeding of the first splice chamber with pressurized air has been terminated; but this is not necessary, since rather there may be (and typically will be) to some degree an overlapping in the feeding of pressurized air to the first and the second splice chamber. For typical applications the time lag between launching the first splice chamber and the second splice chamber may be about 3 seconds or more. Very good results have been achieved by a time lag of 5 seconds.

Experiments made with the air-splicing device of the present invention have shown that by making use of said device and/or applying the process of the present invention, splice joints of glass fiber roving strands can be made the average value of tensile strength of the splice being close to or even higher than the tensile strength usually measured at regular strands without splice. This is a quite surprising result in consideration that application of standard air-splicing devices presently on the market result in a fairly poor quality of the splice joint as set out above.

According to a first preferred embodiment of the present invention there may be a distance between said two splice chambers of about 3 to 6 cm, preferably between about 4 and 5 cm. Best quality results in typical glass fiber roving splicing applications have been achieved with thus dimensioned air-splicing devices according to the invention.

A second preferred embodiment of the inventive air-splicing device is characterized in that said two strand cutters are located on either side outside of said two outer strand clamps. With other words, the two outer strand clamps are preferably arranged between the two strand cutters. Again this is quite surprising because the strand clamps fix both roving strands in the respective splice chamber on either side thereof which, in consideration of the prior art teaching, would have to be regarded rather detrimental for the quality of the splice joint.

According to a still further preferred embodiment of the present invention the air-splicing device comprises exactly four strand clamps two of which are arranged pair-wise on either side of the first splice chamber and the other two of which are arranged pair-wise on either side of the second splice chamber. Thus there are provided, in this particular embodiment, two outer strand clamps and two inner strand clamps, wherein there may be preferably a distance of about 3 to 5 cm between the said two inner strand clamps. Preferably, each of the strand clamps of this embodiment is adapted to fix both roving strands which are fixed by the strand clamps in an essentially parallel alignment next to each other. This, again, is a significant difference as compared with typical prior art air-splicing devices in which the two filaments cross each other in about the middle of the splice chamber but are spaced from each other at both edges thereof, to which end both strands are fixed on either side of the splice chamber by individual strand clamps spaced apart with respect to each other.

In a still further preferred embodiment the air-splicing device further comprises a control unit with a memory having stored at least one splicing programme controlling the individual mechanical components of the air-splicing device, said splicing programme actuating at least one strand clamp located outside of said first splice chamber and at least one strand clamp located between the two splice chambers for fixing both glass fiber roving strands in the region of the first splice chamber, feeding pressurised air to the first splice chamber, actuating at least one strand clamp located outside of said second splice chamber and at least one strand clamp located between the two splice chambers for fixing both glass fiber roving strands in the region of the second splice chamber, feeding pressurised air to the second splice chamber timely offset with respect to said feeding of pressurized air to the first splice chamber, actuating both strand cutters for cutting off the free ends of both glass fiber roving strands.

The duration of the individual feeding of pressurized air to the splice chambers, the time lag between initializing the feeding of pressurized air to the first and the second splice chamber respectively, and any other appropriate parameter of the splicing programme can be stored in the memory of the splicing unit depending on the individual splicing application. E.g., the control unit, in response to said stored splicing programme, may initiate feeding pressurised air to the second splice chamber only after feeding pressurised air to the first splice chamber has been terminated.

Whereas, depending on the individual time lag between initializing the feeding of pressurized air to the first and the second splice chamber respectively, the strand clamps fixing the two roving strands in the region of the second splice chamber may be actuated timely offset only after actuating the strand clamps fixing the two roving strands in the region of the first splice chamber, the control unit, in response the individual stored splicing programme, may actuate all of the strand clamps simultaneously for fixing both glass fiber roving strands in the region of both splice chambers, before initiating feeding pressurised air to the first splice chamber.

Similar applies to actuation of the strand cutters. Whereas, depending on the individual time lag between the feeding of pressurized air to the first and the second splice chamber respectively, the strand cutter next to the first splice chamber may be actuated (before or after termination of feeding pressurized air to the second splice chamber) earlier than the strand cutter next to the second splice chamber, the control unit, in response the individual stored splicing programme, may actuate both strand cutters simultaneously only after termination of feeding pressurized air to the second splice chamber.

According to another aspect of the present invention a process of splice-connecting two glass fiber roving strands by making use of an inventive air-splicing device discussed above comprises the following steps:

introducing the two glass fiber roving strands into the strand channel;

fixing the two glass fiber roving strands in the region of the first splice chamber by at least two strand clamps arranged at either side of the first splice chamber;

feeding pressurised air to said first splice chamber;

fixing the two glass fiber roving strands in the region of the second splice chamber by at least two strand clamps arranged at either side of the second splice chamber;

feeding pressurised air to said second splice chamber timely offset with respect to said feeding pressurised air to said first splice chamber;

cutting off the free ends of the strands by actuating the strand cutters.

In order to avoid repetitions reference is made to the above explanations of the inventive air-splicing device which explanations also highlight the advantages of the method set out above. In view of the particular relevance thereof, it is to be mentioned at this point only that most preferably the two roving strands are inserted into the strand channel in an essentially parallel alignment next to each other.

Just by way of precaution it shall be mentioned that the strand clamps need not to be clamps which allow positive actuation for a predetermined time for engaging the strands and releasing same after actuation has been terminated. Rather, the strand clamps may be of a type that fixes the respective strand, upon inserting same into the clamp, without further e.g. by some friction. This is particularly useful if the device is designed for hand-held operation since it allows introducing, with only one hand, the two strands one after the other into the strand channel and the strand clamps located therein while the operator holds the device with his other hand.

Figure 2:
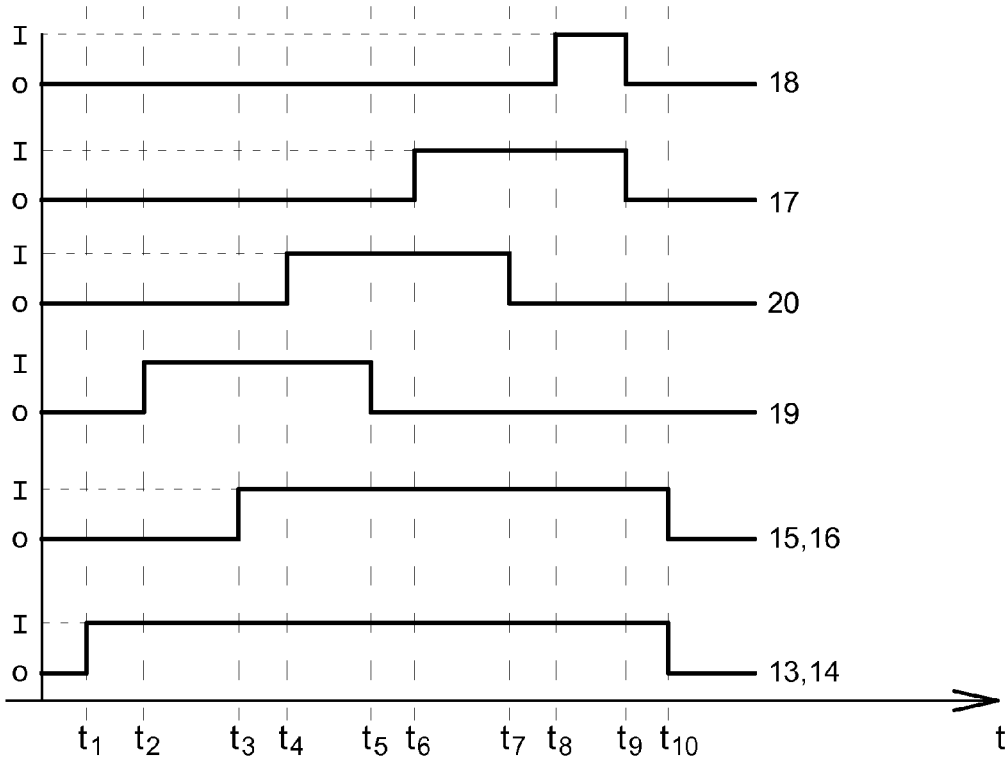
FIG. 2 illustrates the sequence of events relating to the operation of the air-splicing device of FIG. 1.

In the following, a preferred embodiment of the present invention is described in detail, making reference to the attached drawing in which FIG. 1 shows a schematic cut through a preferred air-splicing device according to the present invention and FIG. 2 shows a diagram illustrating a process to be performed by said device.

The air-splicing device shown in FIG. 1 is adapted to splice-connecting two glass fiber roving strands such as the inner trailing strand 1 of a first glass fiber roving bobbin 2 to the outer trailing strand 3 of a second glass fiber roving bobbin 4. It comprises a housing 5 having a strand channel 6 which is open at its two opposing ends, i.e. the first end 7 and the second end 8, such that said first strand 1 and said second strand 3 can pass straight through said strand channel 6.

The strand channel 6 receives a first splice chamber 9 and a second splice chamber 10 which are arranged side-by-side with a distance of about 5 cm. Air supply ducts 11 and 12 run into the first splice chamber 9 and a second splice chamber 10 respectively which air ducts are connectable to a typical pressurized air source (not shown).

The strand channel receives four strand clamps namely a first outer strand clamp 13 and a first inner strand clamp 14 which are arranged pair-wise on either side of the first splice chamber 9 and a second outer strand clamp 15 and a second inner strand clamp 16 which are arranged pair-wise on either side of the second splice chamber 10. Thus there are provided two outer strand clamps 13 and 15 and two inner strand clamps 14 and 16, there being a distance of about 4 cm between the latter. Each of the strand clamps is adapted to fix both roving strands 1 and 3 which are fixed by the strand clamps in a parallel alignment immediately next to each other.

Further, the strand channel 6 receives two strand cutters namely a first strand cutter 17 being arranged next to and outside of the first outer strand clamp 13 and a second strand cutter 18 being arranged next to and outside of the second outer strand clamp 15.

Still further the air-splicing device comprises a control unit 19 with a memory having stored at least one splicing programme controlling the actuating of individual mechanical components of the air-splicing device such as the four strand clamps 13 to 16, the two strand cutters 17 and 18 and a first valve 19 and a second valve 20 arranged in the first air supply duct 11 and the second air supply duct 12 respectively. As shown in more detail in FIG. 2, the control unit 19, reflecting the particular splice programme stored in the memory thereof, positively actuates all four strand clamps 13, 14, 15, and 16, the first valve 19 and the second valve 20, as well as the first strand cutter 17 and the second strand cutter 18. The scheme being as follows:

After having inserted both strands 1 and 3 into the strand channel 6, the splicing programme is triggered by pressing the switch 20 which may be provided in the region of a grip of the device. At the time $t_1$ the first pair of strand clamps, i.e. the first outer strand clamp 13 and the first inner strand clamp 14, are actuated to engage both strands and to fix same, in the region of the first splice chamber 9, in a parallel alignment immediately next to each other. At the time $t_2$ the valve 19 is opened to launch feeding pressurized air into the first splice chamber 9. At the time $t_3$ the second pair of strand clamps, i.e. the second outer strand clamp 15 and the second inner strand clamp 16, are actuated to engage both strands and to fix same, in the region of the second splice chamber 10, in a parallel alignment immediately next to each other. At the time $t_4$ the valve 20 is opened to launch feeding pressurized air into the second splice chamber 10. At the time $t_5$ feeding pressurized air to the first splice chamber 9 is terminated. At the time $t_6$ the first strand cutter 17 is actuated to cut off the protruding end section 21 of the outer trailing strand 3 of the second glass fiber roving bobbin 4. At the time $t_7$ feeding pressurized air to the second splice chamber 10 is terminated. At the time $t_8$ the second strand cutter 18 is actuated to cut off the protruding end section 22 of the inner trailing strand 1 of the first glass fiber roving bobbin 2. At the time $t_9$ both strand cutters 17 and 18 are deactivated. And at the time $t_{10}$ all four strand clamps 13, 14, 15, and 16 are deactivated. Now the splicing process cycle has finished and the two roving strands 1 and 3 are splice connected.

Apparently, the above described process is just an example which is not binding and from which an expert may deviate in many regards. E.g., the first and the second pair of strand clamps may rather be actuated simultaneously instead of consecutively and/or may be deactivated rather consecutively instead of simultaneously. Similarly the first and second strand cutters may rather be actuated simultaneously (after termination of feeding pressurized air to the second splice chamber 10) instead of consecutively and/or may be deactivated rather consecutively instead of simultaneously. And still further, the strand clamps, as mentioned earlier, need not to be of a type requiring individual positive actuation and deactivation but may rather be of a type that fixes the respective strand, upon inserting same into the clamp, without further e.g. by some friction.

The invention claimed is:

1. Air-splicing device for splice-connecting two glass-fiber roving strands, comprising:

a strand channel open at its two opposing ends;

two splice chambers arranged side-by-side in said strand channel, said first and second splice chambers being feedable with pressurized air independently of each other;

at least three strand clamps two of which are outer strand clamps arranged at either side outside of said two splice chambers and at least one of which is an inner strand clamp arranged between said two splice chambers; and two strand cutters arranged at the opposite ends of the strand channel.

2. Air-splicing device according to claim 1, wherein there is a distance of 3 to 6 cm between said two splice chambers.

3. Air-splicing device according to claim 2, wherein there is a distance of 4 to 5 cm between said two splice chambers.

4. Air-splicing device according to claim 1, wherein said two strand cutters are located on either side outside of said two outer strand clamps.

5. Air-splicing device according to claim 1, comprising exactly four strand clamps two of which are arranged pair-wise on either side of the first splice chamber and the other two of which are arranged pair-wise on either side of the second splice chamber.

6. Air-splicing device according to claim 5, wherein there is a distance of 3 to 5 cm between those two inner strand clamps which are arranged between the two splice chambers.

7. Air-splicing device according to claim 1, wherein each of the strand clamps is adapted to fix both roving strands in an essentially parallel alignment next to each other.

8. Air-splicing device according to claim 1 further comprising:

a control unit with a memory having stored at least one splicing program controlling the individual mechanical components of the air-splicing device, said splicing program actuating at least one strand clamp located outside of said first splice chamber and at least one strand clamp located between the two splice chambers for fixing both glass fiber roving strands in the region of the first splice chamber;

feeding pressurized air to the first splice chamber, actuating at least one strand clamp located outside of said second splice chamber and at least one strand clamp located between the two splice chambers for fixing both glass fiber roving strands in the region of the second splice chamber;

feeding pressurized air to the second splice chamber timely offset with respect to said feeding of pressurized air to the first splice chamber; and actuating both strand cutters for cutting off the free ends of both glass fiber roving strands.

9. Air-splicing device according to claim 8, wherein the control unit, in response to said stored splicing program, initiates feeding of the second splice chamber with pressurized air only after feeding of the first splice chamber with pressurized air has been terminated.

10. Air-splicing device according to claim 8, wherein the control unit, in response to said stored splicing program, actuates all of the strand clamps simultaneously for fixing both glass fiber roving strands in the region of both splice chambers, before initiating feeding pressurized air to the first splice chamber.

11. Air-splicing device according to claim 8, wherein the control unit, in response to said stored splicing program, actuates at least one of the strand cutters only after termination of feeding pressurized air to said second splice chamber.

12. Air-splicing device according to claim 11, wherein the control unit, in response to said stored splicing program, actuates both strand cutters only after termination of feeding pressurized air to said second splice chamber.

13. Process of splice-connecting two glass fiber roving strands by making use of an air-splicing device according to claim 1, the process comprising the following steps:

introducing the two glass fiber roving strands into the strand channel;

fixing the two glass fiber roving strands in the region of the first splice chamber by at least two strand clamps arranged at either side of the first splice chamber;

feeding pressurized air to said first splice chamber;

fixing the two glass fiber roving strands in the region of the second splice chamber by at least two strand clamps arranged at either side of the second splice chamber;

feeding pressurized air to said second splice chamber timely offset with respect to said feeding pressurized air to said first splice chamber; and cutting off the free ends of the strand by actuating the strand cutters.

14. Process according to claim 13, wherein the two glass fiber roving strands are inserted into the strand channel in an essentially parallel alignment next to each other.

* * * * *